US005506476A

United States Patent [19]

Lee et al.

[11] Patent Number: 5,506,476

[45] Date of Patent: Apr. 9, 1996

[54] FIELD EMISSION CATHODE

[75] Inventors: Gyun-gyoo Lee, Kwacheon; Sun-jeong Choi, Suwon, both of Rep. of Korea

[73] Assignee: Samsung Display Devices Co., Ltd., Kyungki, Rep. of Korea

[21] Appl. No.: 212,852

[22] Filed: Mar. 15, 1994

[30] Foreign Application Priority Data

Mar. 17, 1993 [KR] Rep. of Korea ..... 93-4093

[51] Int. Cl.[6] ..... H05B 37/00

[52] U.S. Cl. ..... 315/167; 315/162; 445/35; 445/46; 313/364

[58] Field of Search ..... 315/167, 161, 315/162; 445/46, 47, 35; 313/364

[56] References Cited

U.S. PATENT DOCUMENTS 3,662,214 5/1972 Lustig ..... 315/167
5,315,213 5/1994 Kim ..... 315/167

*Primary Examiner*—Robert J. Pascal
*Assistant Examiner*—Reginald A. Ratliff
*Attorney, Agent, or Firm*—Leydig, Voit & Mayer

[57] ABSTRACT

A field emission cathode includes first and second cathode layers having respective projections and disposed on the surface of a substrate. An insulating layer having an opening and disposed on the surface of the cathode layer surrounds the projections. A field emission tip includes the projections, one of which is annular and projects beyond the other so that the field emission tip has a crater-like shape which improves the electron emission characteristic of the cathode.

3 Claims, 4 Drawing Sheets

FIELD EMISSION CATHODE

BACKGROUND OF THE INVENTION

The present invention relates to a field emission cathode generally used for microsensors, high-speed switching devices and other various display devices and to a manufacturing method thereof and, more particularly, to a field emission cathode with high emission characteristics due to electron emission share and minimized tip abrasion, and to a manufacturing method thereof.

FIG. 1 is a vertical cross-sectional view of the conventional field emission cathode generally used in various areas as stated above.

First, to review the structure thereof, a cathode 2 having a needle-shaped field emission tip 4 is formed on a substrate 1 in a predetermined pattern, an oxide layer 3 is formed on the surface of the cathode around the tip 4, an insulation layer 5 is deposited thereon, and a pin hole 7 is finally formed. Also, a gate electrode 6 is deposited on the insulation layer 5.

To form such a structure, the processes proceed in the order as shown in FIGS. 3 to 8.

In other words, cathode layer 2 is deposited on the substrate 1 and the surface thereof is thermally oxidized to then form an oxide layer. The oxide layer is etched in a predetermined pattern to then form a mask as shown in FIG. 4. Thereafter, etching is performed as shown in FIG. 5 to shape an emitter tip on the cathode layer, roughly, and the surface is again thermally oxidized as shown in FIG.6. If the oxide layer is removed, a sharp needle-shaped emitter tip can be formed. Before the field emission tip is attained, first, an insulation layer 5 and a gate electrode 6 are deposited sequentially around the tip to surrounded the pin hole 7, as 10 shown in FIG. 7. Finally, the deposited layers on the tip are lifted off, the oxide layer is removed and then a needle-shaped tip is exposed, as shown in FIG.8.

In the conventional field emission cathode constituted as described above, a predetermined voltage potential is applied to the cathode 2 and gate electrode 6 and thereby electrons are extracted from the field emission tip 4 formed on the cathode by means of the electric field at a predetermined electrical potential.

However, in the conventional field emission cathode, since the field emission tip formed on the cathode is a single needle-like shape, which means that the surface width of electron emission is very narrow, few electrons are extracted. As shown in FIG. 2, in case the top of the field emitter tip 4 is damaged, the electron emission capability from the top of the field emission tip 4 is rapidly lowered.

SUMMARY OF THE INVENTION

To solve the problem of the aforementioned conventional field emission cathode, an object of the present invention is to provide a field emission cathode with improved electron emission characteristic by extending the surface width of the field emission tip for emitting electrons, particularly improving the life of the field emitter tip, and a manufacturing method thereof.

In a novel field emission cathode and manufacturing method thereof according to the present invention, the surface width of the field emission tip which emits electrons is extended so as to improve the electron emission characteristic, and the top of the tip is formed rotating the substrate whereon a first cathode layer is deposited, in one direction using a predetermined rotating means so as to form the round-shaped top of a second cathode layer.

To accomplish the above object, the field emission cathode according to the present invention comprises:

- a substrate;
- a first cathode layer disposed on the substrate;
- a second cathode layer having a volcano crater-like shaped field emission tip surrounded by a projection of the first cathode layer;
- an insulating layer having multiple pin holes, deposited on the surface surrounding the field emission tip on the second cathode layer; and
- a gate electrode disposed on the insulating layer.

The method for manufacturing the field emitter cathode according to the present invention comprises the steps of:

- forming sequentially a first cathode layer and a masking layer having a predetermined thickness on the whole surface of a substrate;
- forming a mask having a predetermined pattern by etching the masking layer;
- forming projections by etching the first cathode layer through the mask;
- depositing a second cathode layer on the whole surface of the first cathode layer;
- selectively depositing an insulating layer and a gate electrode layer, on the surface of the second cathode layer sequentially;
- removing the deposited layer from the projections and gate electrode layer; and
- wet etching the first cathode layer to form a round top on the second cathode layer.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
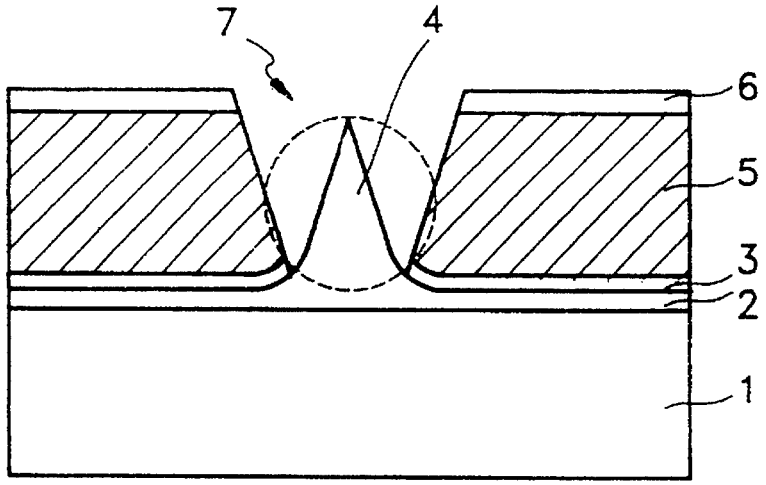
FIG. 1 (PRIOR ART)
FIG. 1 is a cross-sectional view of a conventional field emission cathode.
Figure 2:
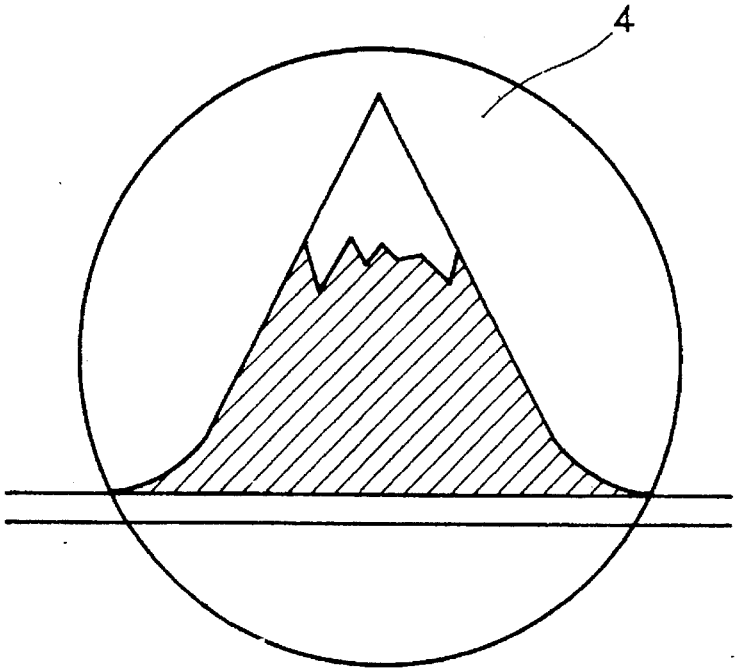
FIG. 2 (PRIOR ART)
FIG. 2 is a side view of the field emission tip shown in FIG. 1.
Figure 3:
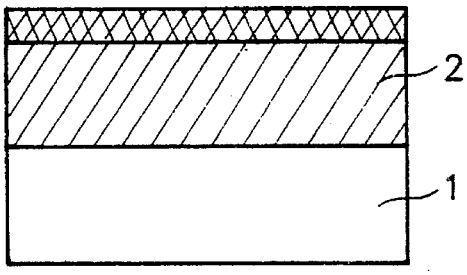
FIG. 3 (PRIOR ART)
FIGS. 3 to 8 are cross-sectional views of conventional field emission cathode processing steps.
Figure 4:
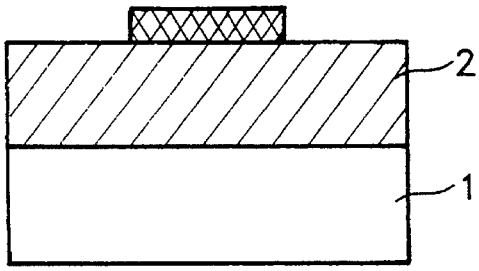
FIG. 4 (PRIOR ART)
Figure 5:
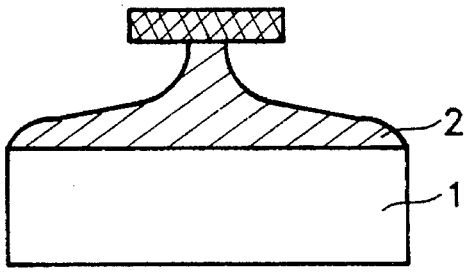
FIG. 5 (PRIOR ART)
Figure 6:
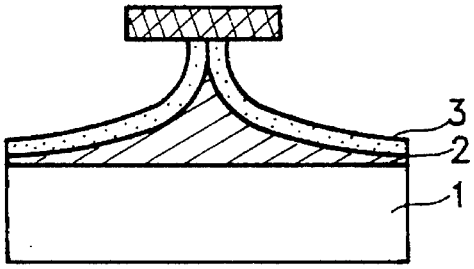
FIG. 6 (PRIOR ART)
Figure 7:
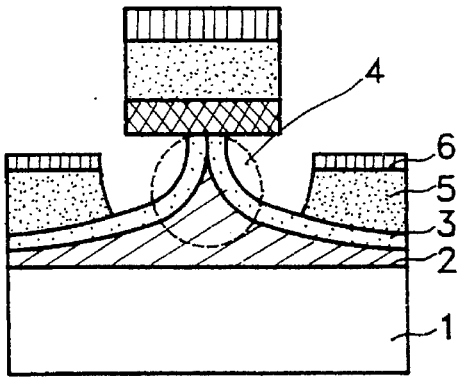
FIG. 7 (PRIOR ART)
Figure 8:
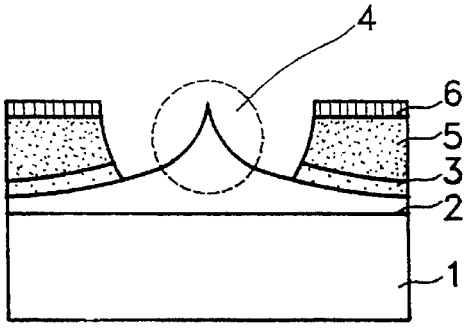
FIG. 8 (PRIOR ART)
Figure 9:
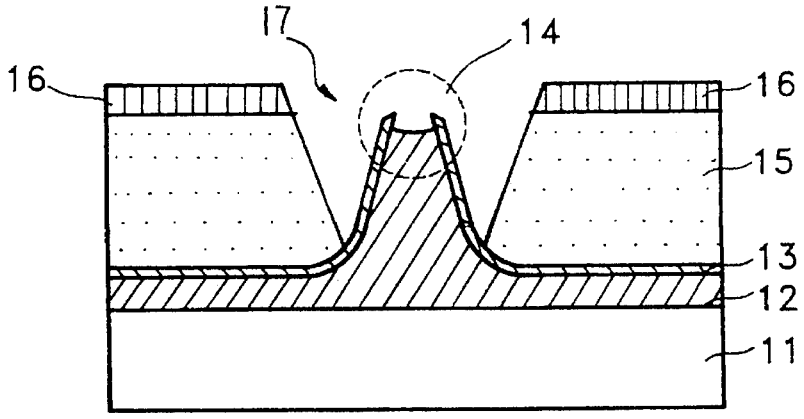
FIG. 9 is a cross-sectional view of the field emission cathode according to the present invention.

As shown in FIG. 9, to manufacture the field emitter cathode according to the present invention, first, a first cathode layer 12 and a second cathode layer 13 having a predetermined pattern are disposed on the substrate 11. An insulation layer 15 having multiple cavities is disposed on the cathode layers 12 and 13. A volcano crater-like shaped field emission tip 14, which includes the cathode layers 12 and 13 physically and electrically, is located within each of the cavities. A gate electrode layer 16 is disposed on the insulating layer 15. In such a manner, the cavities in the insulating layer 15 and the cavities of the gate electrode layer 16 pin holes 17 that surround respective field emission cathodes.

Meanwhile, the cathode layer includes a first cathode layer 12 provided with multiple projections and a second cathode layer 13 together forming the tip 14 for emitting electrons. The second cathode layer is disposed on the first cathode layer 12 and has a volcano crater-like shaped opening.

Also, the method for manufacturing the field emitter cathode according to the present invention will be described with reference to the processing steps shown in FIGS. 10 to 15.

Figure 10:
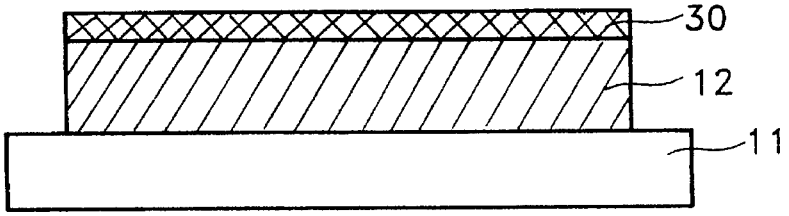
FIGS. 10 to 15 are cross-sectional views showing method for manufacturing the field emission cathode according to the present invention.
Figure 11:
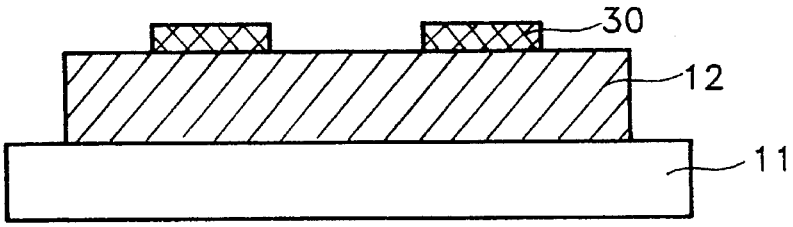
Figure 12:
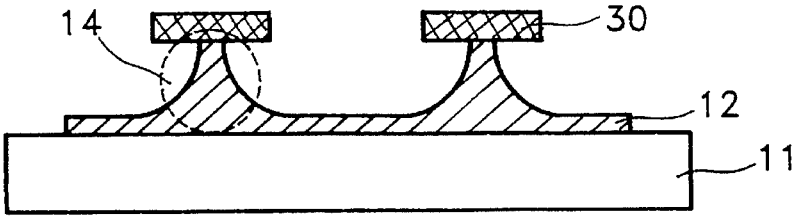
Figure 13:
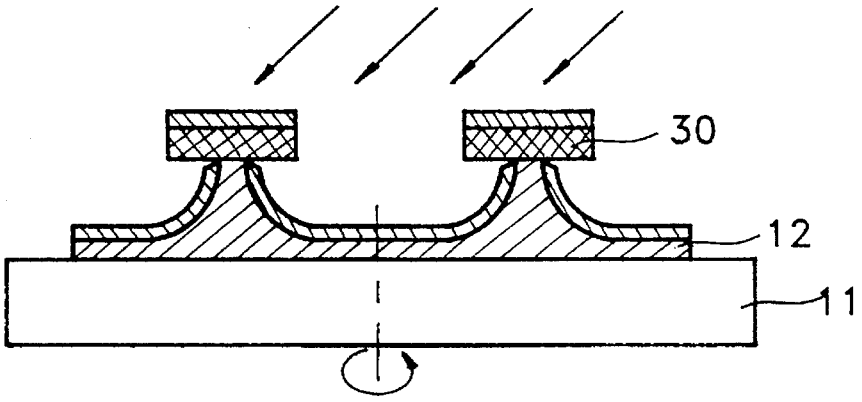
Figure 14:
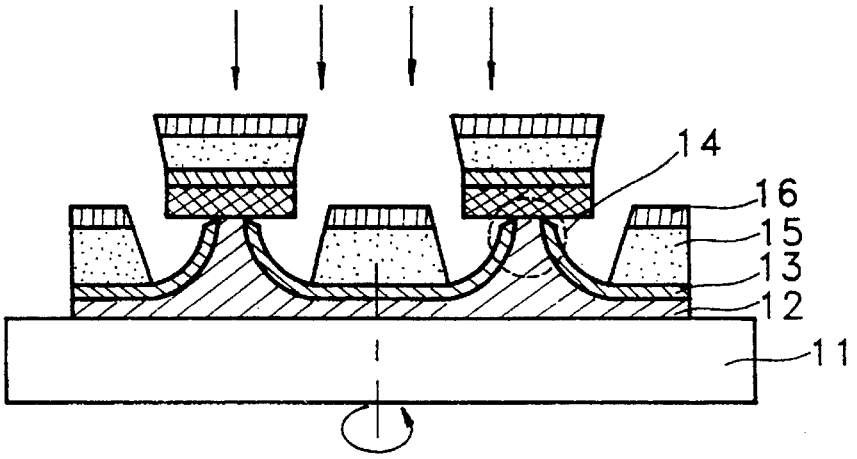
Figure 15:
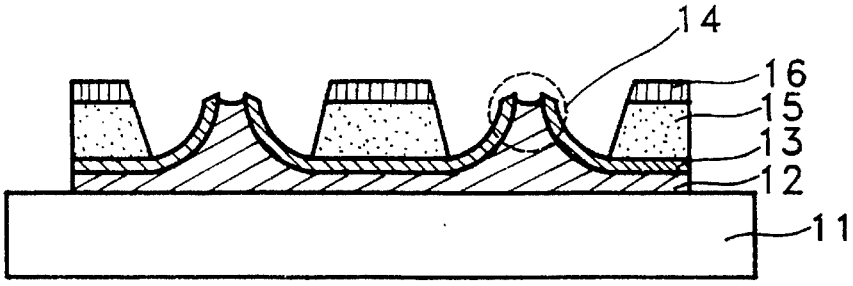

First, as shown in FIG. 10, a first cathode layer 12 is formed on the whole surface of the substrate 11 and a masking layer 30 is formed on the whole surface of the first cathode layer 12. Then, as shown in FIG. 11, the masking layer is etched so as to have a predetermined pattern. The first cathode layer 12 is etched through the mask having a predetermined pattern as shown in FIG. 12 and multiple projections are thereby formed. In this state, a part of the masking layer is located on the top of each of the projections of the first cathode layer 12. In this state, as shown in FIG. 13, a second cathode layer 13 is deposited on the whole surface of the first cathode layer 12. Then, as shown in FIG. 14, an insulating layer 15 and a gate electrode layer 16 are sequentially deposited on the second cathode layer. At this time, in performing the steps of depositing the second cathode layer 13 on the first cathode layer 12 and depositing the insulating layer 15 and gate electrode layer 16 on the second cathode layer 13, it is desirable to make the depositions while rotating the substrate 11 on which the first cathode layer 12 is formed, in one direction. An e-gun evaporator or sputtering machine can be used to form the second cathode layer 13. In the step of depositing the insulation layer 15 and gate electrode layer 16 on the second cathode layer 13, it is desirable to make a deposition in a direction perpendicular to the substrate 11.

In such a state, the masking layer formed on the projections of the first cathode layer 12, the insulation layer 15 and gate electrode layer 16 formed on the masking layer are removed by attacking the projections of the first cathode layer 12. Therefore, the top of the second cathode layer 13 deposited on the first cathode layer 12 is formed as a volcano crater-like shaped opening. In this manner, the top of each of the projections of the second cathode layer 13 has a volcano crater-like shaped opening portion. In other words, there is formed a volcano crater-like shaped field emission tip 14 having an inside recessed to a predetermined depth.

Since the field emitter cathode manufactured by the method as described above, has a top with a annular projection, the top is recessed and the edges sharply protrude so that the surface width of electron emission is larger than that of the conventional field emission tip, thereby improving the electron emission characteristic. Also, when the aforementioned field emission cathode is applied to the respective devices, even if part of the field emission cathode is damaged by anions, electrons are emitted without lowered performance efficiency because of the sharp projections of the annular protruding edge.

Also, the field emission cathode and manufacturing method according to the present invention can improve the output current characteristic greatly, compared to the conventional one because the top of the field emission tip has a crater-like annular shape, and, in application to image-forming devices, microsensors, and switching devices, their performance is particularly improved.

What is claimed is:

1. A field emission cathode comprising:

a substrate;

a first cathode layer disposed on said substrate and having a projection; and a second cathode layer disposed on said first cathode layer and having an annular projection surrounding and projecting beyond the projection of said first cathode layer so that a volcano crater-like field emission tip is formed by said first and second cathode layers.

2. The field emission cathode of claim 1 including an insulating layer having an opening and disposed on said second cathode layer with said field emission tip disposed within the opening.

3. The field emission cathode of claim 2 including a gate electrode disposed on the insulating layer.

* * * * *